US008666107B2

(12) United States Patent
Tzeng

(10) Patent No.: US 8,666,107 B2
(45) Date of Patent: Mar. 4, 2014

(54) LOUDSPEAKER

(75) Inventor: Guan-Hua Tzeng, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 136 days.

(21) Appl. No.: 13/444,017

(22) Filed: Apr. 11, 2012

(65) Prior Publication Data

US 2013/0272562 A1 Oct. 17, 2013

(51) Int. Cl.
*H04R 1/02* (2006.01)

(52) U.S. Cl.
USPC ..... 381/394; 381/387; 381/395

(58) Field of Classification Search
USPC ..... 381/387, 394, 395
See application file for complete search history.

(56) References Cited

U.S. PATENT DOCUMENTS

| | | | | | |
|---|---|---|---|---|---|
| 3,483,945 | A * | 12/1969 | Stanley | 181/143 |
| 3,541,452 | A * | 11/1970 | Disesa et al. | 455/157.1 |
| 3,720,787 | A * | 3/1973 | Ishii et al. | 381/336 |
| 3,739,096 | A * | 6/1973 | Iding | 381/387 |
| 5,191,177 | A * | 3/1993 | Chi | 181/153 |
| 6,374,942 | B1 * | 4/2002 | Huggins | 181/150 |
| D487,075 | S * | 2/2004 | Dayan | D14/216 |
| 6,724,907 | B1 * | 4/2004 | Chan | 381/386 |
| 6,798,892 | B2 * | 9/2004 | Parnell | 381/386 |
| 6,856,692 | B2 * | 2/2005 | Lin | 381/395 |
| 6,969,209 | B2 * | 11/2005 | Apar et al. | 401/175 |
| 7,769,408 | B2 * | 8/2010 | Hansson | 455/550.1 |
| 8,199,957 | B2 * | 6/2012 | Ohguchi et al. | 381/386 |
| 2002/0118858 | A1 * | 8/2002 | White et al. | 381/430 |
| 2007/0183618 | A1 * | 8/2007 | Ishii et al. | 381/387 |
| 2008/0063225 | A1 * | 3/2008 | Choi | 381/305 |
| 2008/0095395 | A1 * | 4/2008 | Pieklik et al. | 381/387 |
| 2008/0112588 | A1 * | 5/2008 | Konig | 381/395 |
| 2008/0123894 | A1 * | 5/2008 | Lu | 381/394 |
| 2008/0226096 | A1 * | 9/2008 | Waddell et al. | 381/87 |
| 2008/0304692 | A1 * | 12/2008 | Zhang | 381/387 |
| 2011/0170724 | A1 * | 7/2011 | Lin | 381/332 |

* cited by examiner

*Primary Examiner* — Duc Nguyen
*Assistant Examiner* — Sean H Nguyen

(57) ABSTRACT

A loudspeaker includes a housing, a conducting sound element, a rotating element, and a modulating element slidably mounted to the rotating element. The housing defines an insertion chamber and a notch. The conducting sound element is mounted in a front of the insertion chamber. The rotating element is rotatablely mounted in a rear of the insertion chamber. A rear end of the rotating element defines a holding groove. A portion of the rear surface of the rotating element is recessed forward to form a sliding groove. A front surface of the modulating element is equipped with an audio plug and defines a sliding element slidably located in the sliding groove. The audio plug is capable of being inserted into the holding groove or projecting out of the holding groove and the notch under a rotation of the modulating element together with the rotating element with respect to the housing.

5 Claims, 5 Drawing Sheets

LOUDSPEAKER

BACKGROUND OF THE INVENTION

1. Field of the Invention

The present invention generally relates to a loudspeaker, and more particularly to a portable loudspeaker.

2. The Related Art

With the continuous improvement of science and technology, electronic accessories, such as earphones and loudspeakers, have been widely used in electronic products. Though the earphones are conveniently carried by listeners, it will bring discomfort for the listeners who use the earphones for a long time. In that case, some listeners generally choose the loudspeakers to connect with the electronic products and an external power so as to enjoy sound information with others.

However, the loudspeaker is connected with the electronic product and the external power by means of cables assembled in the loudspeaker. The cables make the loudspeaker too big to be conveniently carried by the listeners. Furthermore, the loudspeaker relies on the external power to work that brings inconvenience for the listeners who want to use the loudspeakers at any time.

SUMMARY OF THE INVENTION

An object of the present invention is to provide a loudspeaker includes a hollow housing, a conducting sound element, a rotating element and a modulating element. The housing defines an insertion chamber extending along a front-to-rear direction to penetrate through a front face and a rear face of the housing. A rear edge of the housing is recessed forward to form a notch passing through an outer surface of the housing and further communicating with the insertion chamber. The conducting sound element is mounted in a front of the insertion chamber of the housing. The rotating element is rotatablely mounted in a rear of the insertion chamber of the housing. A rear end of a side of an outer surface of the rotating element is recessed inward to form a holding groove penetrating rearward through a rear surface of the rotating element. A portion of the rear surface of the rotating element is recessed forward to form a sliding groove connecting with a rear of the holding groove. The modulating element is slidably mounted to the rotating element. A front surface of the modulating element is equipped with an audio plug and further protrudes forward to form a sliding element slidably located in the sliding groove. The audio plug is capable of being inserted into the holding groove or projecting out of the holding groove and the notch under a rotation of the modulating element together with the rotating element with respect to the housing.

As described above, the modulating element together with the rotating element rotates with respect to the housing to make the audio plug project out of the notch and the holding groove so as to facilitate for the audio plug connecting with an electronic product directly. Thus, the loudspeaker has a compact structure to make the loudspeaker portable.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
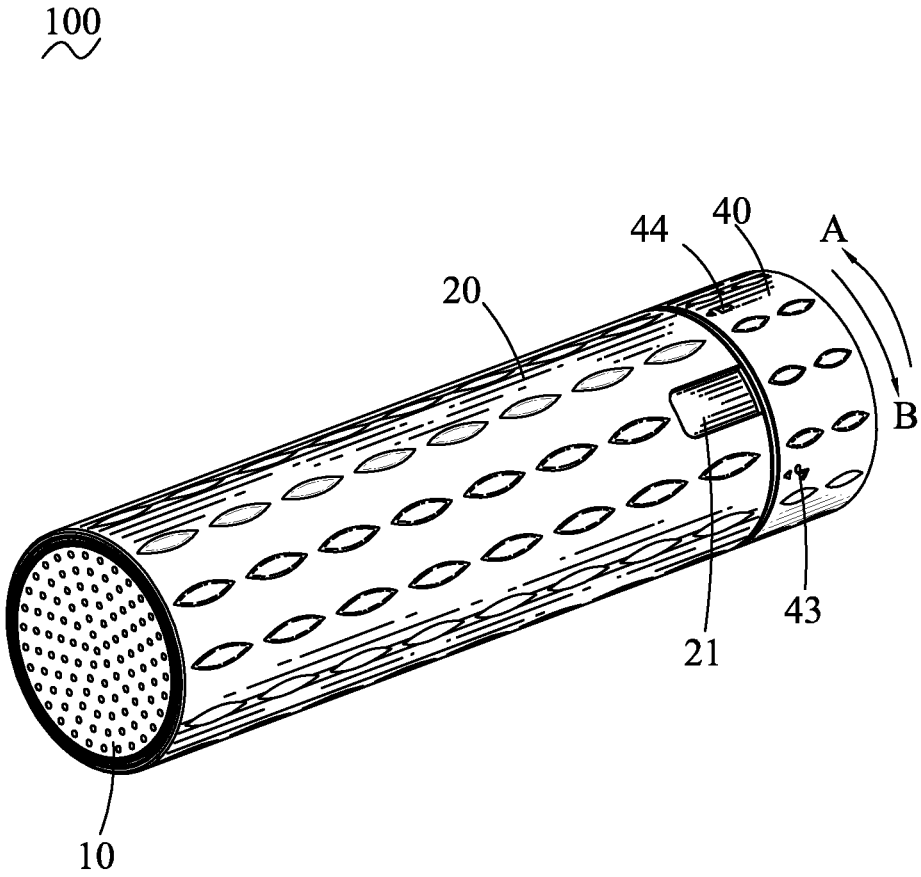
FIG. 1 is a perspective view of a loudspeaker in accordance with the present invention.
Figure 2:
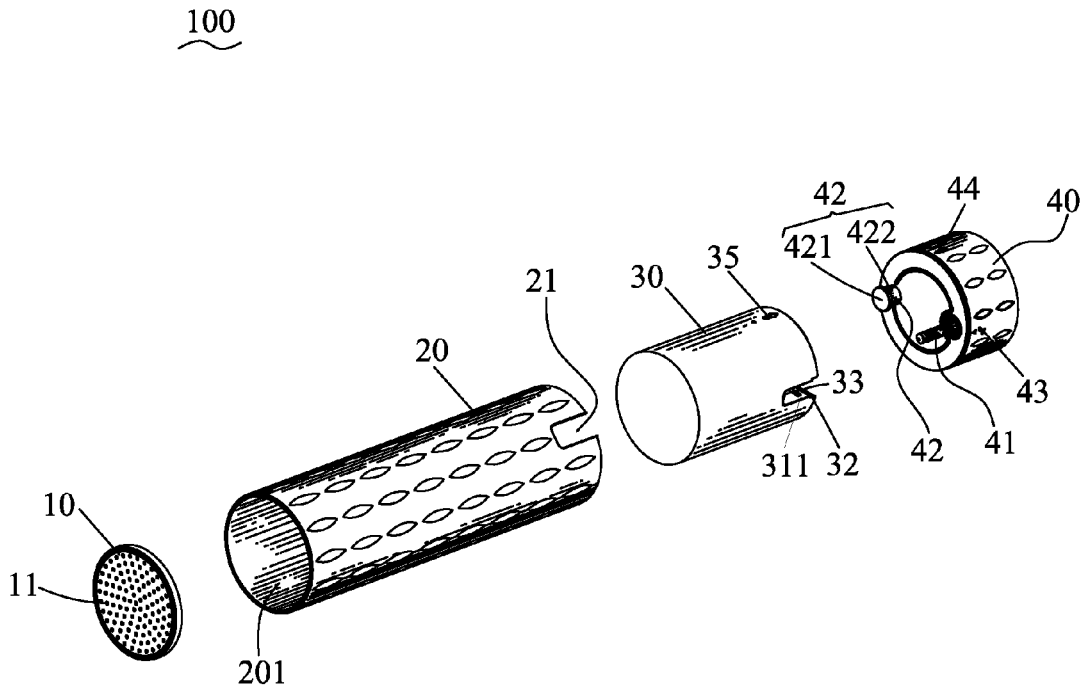
FIG. 2 is an exploded view of the loudspeaker of FIG. 1.

With reference to FIG. 1 and FIG. 2, a loudspeaker 100 in accordance with the present invention is shown. The loudspeaker 100 includes a hollow housing 20, a conducting sound element 10, a rotating element 30 and a modulating element 40.

Referring to FIG. 1 and FIG. 2, the conducting sound element 10 of a disk shape defines a plurality of through-holes 11 penetrating therethrough along a front-to-rear direction. The housing 20 defines an insertion chamber 201 extending along the front-to-rear direction to penetrate through middles of a front face and a rear face of the housing 20. A rear edge of the housing 20 is recessed forward to form a notch 21 passing through an outer surface of the housing 20 and further communicating with the insertion chamber 201. An outer surface of the housing 20 defines a plurality of first indentations (not shown) for improving feelings of holding the housing 20 of the loudspeaker 100. The conducting sound element 10 is mounted in a front of the insertion chamber 201 of the housing 20. A front surface of the conducting sound element 10 is flush with a front periphery of the housing 20.

Figure 3:
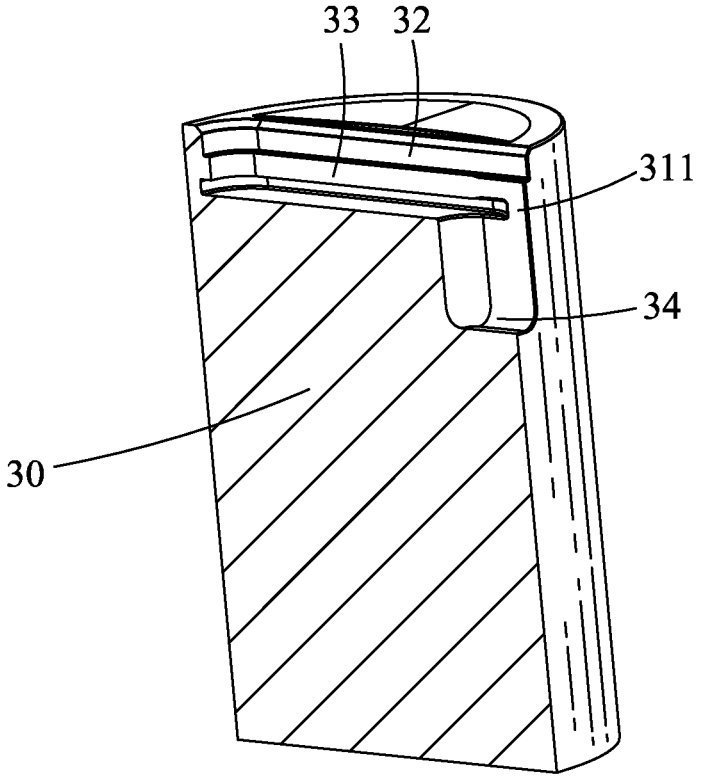
FIG. 3 is a cross-sectional view of a rotating element of the loudspeaker of FIG. 2.
Figure 4:
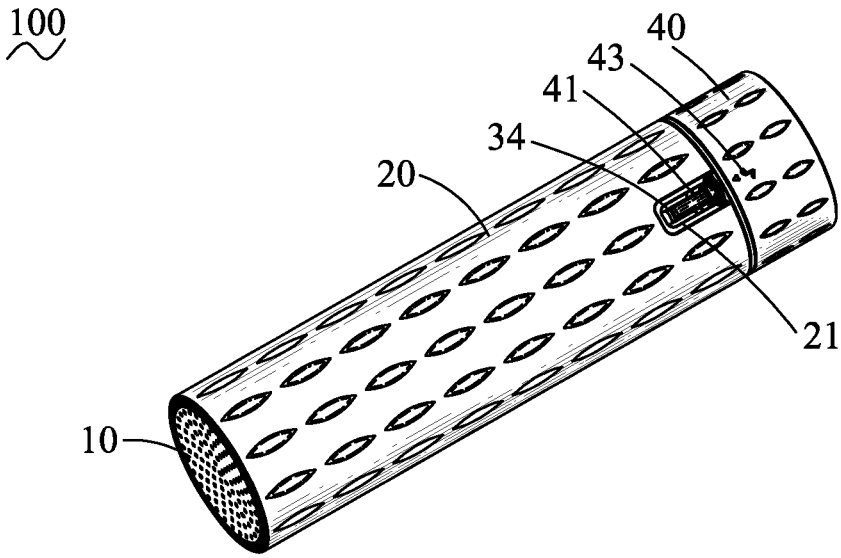
FIG. 4 is a perspective view of the loudspeaker of FIG. 2, wherein a notch of a housing of the loudspeaker is corresponding to a second mark defining on a modulating element of the loudspeaker and a holding groove of the rotating element to expose an audio plug of the modulating element outside.
Figure 5:
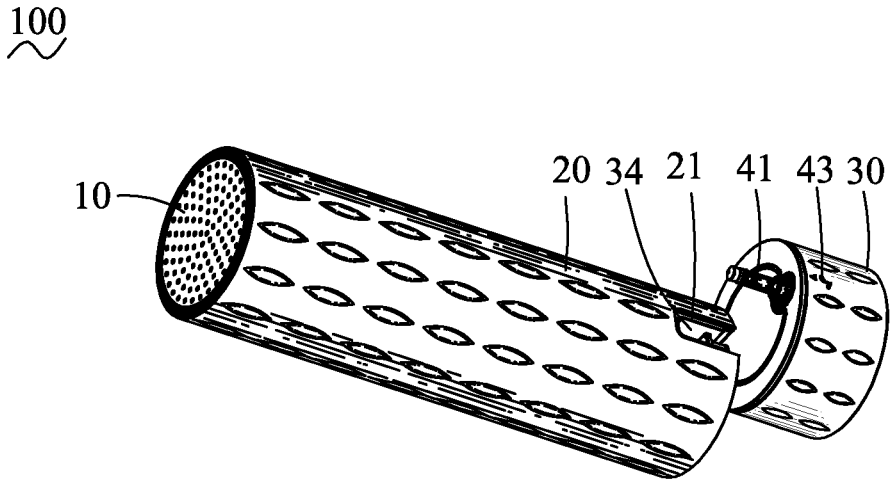
FIG. 5 is a perspective view of the loudspeaker of FIG. 2, wherein the audio plug of the rotating element projects out of the holding groove of the rotating element and the notch of the housing.
Figure 6:
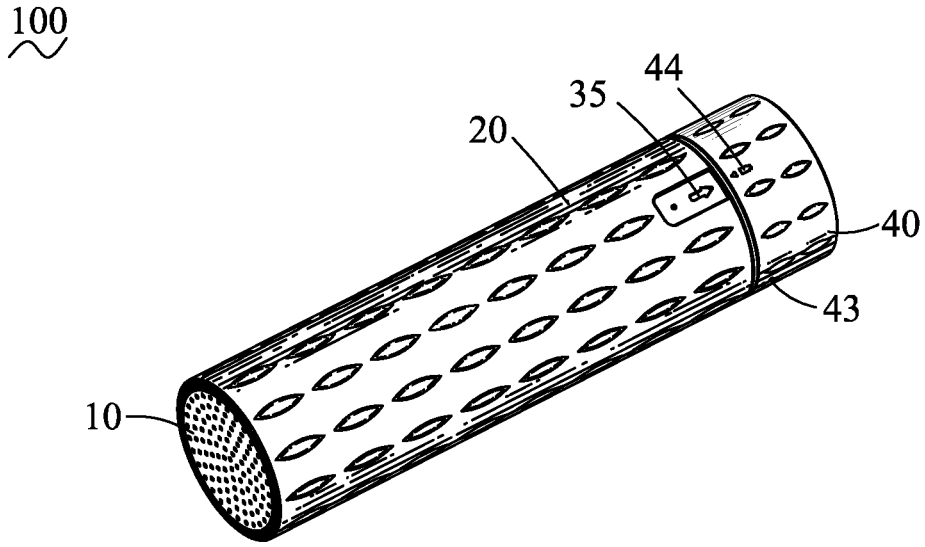
FIG. 6 is a perspective view of the loudspeaker of FIG. 2, wherein the notch of the housing is corresponding to a first mark of the rotating element and a third mark of the modulating element.
Figure 7:
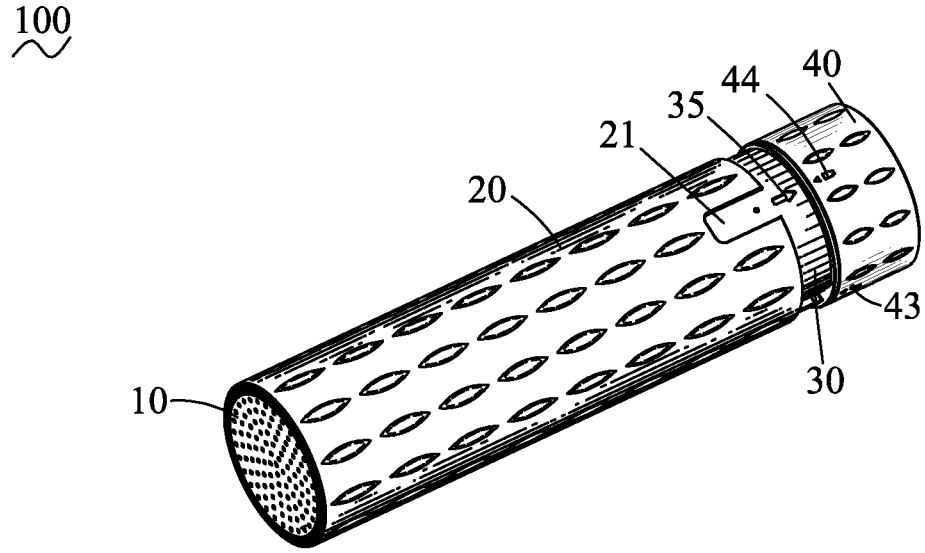
FIG. 7 is a perspective view of the loudspeaker of FIG. 2, wherein the rotating element together with the modulating element is drawn out of the housing.

Referring to FIGS. 1-3, the rotating element 30 of a cylindrical shape is rotatablely mounted in a rear of the insertion chamber 201 of the housing 20. A rear end of an outer surface of the rotating element 30 is recessed inward to form a holding groove 34 penetrating rearward through a rear surface of the rotating element 30. The holding groove 34 shows an arc shape from a rear view. A middle of the rear surface of the rotating element 30 is recessed forward to form a sliding groove 32 of which each end shows the arc shape with the mouth thereof facing to the holding groove 34. A rear of the holding groove 34 connects with an inner side of one end of the sliding groove 32. Two free ends of the one end of the sliding groove 32 passes through the side of the rotating element 30. An inner sidewall of the sliding groove 32 protrudes inward to form a restricting rib 33 of a substantial U-shape from a rear view with the mouth thereof facing the holding groove 34. The restricting rib 33 is spaced from a front sidewall of the sliding groove 32. Two free ends of the restricting rib 33 protrude forward to form two blocking blocks 311 connected with the front sidewall of the sliding groove 32. The rear end of the outer surface of the rotating element 30 defines an arrowhead-shaped first mark 35 with an arrowhead thereof pointing rearward. The first mark 35 is apart from the holding groove 34.

Referring to FIG. 1, FIG. 2 and FIG. 3, the modulating element 40 is of a cylindrical shape. An outer surface of the modulating element 40 defines a plurality of second indentations (not shown) for improving feelings of holding the modulating element 40 of the loudspeaker 100. One side of a front surface of the modulating element 40 is equipped with an audio plug 41 adjacent to one side of a front periphery of the modulating element 40. The other side of the front surface of the modulating element 40 further protrudes forward to form a sliding element 42 adjacent to the other side of the front periphery of the modulating element 40. The sliding element 42 has a limiting portion 421 located at a front thereof, and a sliding pillar 422 connecting between a rear of the limiting portion 421 and the side of the front surface of the modulating element 40. The limiting portion 421 is wider than the sliding pillar 422 in diameter. One side of the outer surface of the modulating element 40 defines a second mark 43 of a music sign shape. The second mark 43 is aligned with the audio plug 41 along a radial direction of the rotation of the modulating element 40 and the rotating element 30. A top of the outer surface of the modulating element 40 defines an arrowhead-shaped third mark 44 with an arrowhead thereof pointing forward. The third mark 44 is aligned with the first mark 35 along the front-to-rear direction when the audio plug 41 is inserted in the holding groove 34. The modulating element 40 is slidably mounted to the rotating element 30. The limiting portion 421 of the modulating element 40 is slidably restricted between the front sidewall of the sliding groove 32 and the restricting rib 33. The limiting portion 421 of the modulating element 40 is blocked by the blocking blocks 311 for preventing the limiting portion 421 from falling off the rotating element 30. The sliding pillar 422 is slidably located in an upper portion of the sliding groove 32. Push the limiting portion 421 of the modulating element 40 to slide to the other end of the bottom of the sliding groove 32 away from the holding groove 34 so as to drive the sliding element 42 to slide to the end of the sliding groove 32 away from the holding groove 34 to make the sliding pillar 422 of the modulating element 42 resist against the arc-shaped inner end of the restricting rib 33. The audio plug 41 of the modulating element 40 is inserted into the holding groove 34. The third mark 44 of the modulating element 40 is corresponding to the first mark 35 of the rotating element 30. Then the rotating element 30 together with the modulating element 40 is rotatablely mounted to the rear of the insertion chamber 201 of the housing 20 with a front periphery of the modulating element 40 resisting against a rear periphery of the housing 20 and the rear surface of the rotating element 30 being flush with the rear periphery of the housing 20.

Referring to FIGS. 1-7, in use, the modulating element 40 together with the rotating element 30 rotates with respect to the housing 20 to make the notch 21 and the holding groove 34 in alignment with each other for the convenience of taking out of the audio plug 41 through the notch 21 and the holding groove 34, or make the first mark 35 exposed through the notch 21 for the convenience of pulling the rotating element 30 out of the housing 20 so as to put external batteries in the insertion chamber 201 of the housing 20. The audio plug 41 is capable of being inserted into the holding groove 34 or projecting out of the holding groove 34 and the notch 21 under the rotation of the modulating element 40 together with the rotating element 30 with respect to the housing 20. Specifically, the modulating element 40 together with the rotating element 30 rotates with respect to the housing 20 along a direction A shown in FIG. 1, the rotating element 30 is brought along by the limiting portion 421 of the sliding element 42 to rotate along the direction A until the notch 21 and the holding groove 34 are in alignment with each other for the convenience of taking out of the audio plug 41 through the notch 21 and the holding groove 34 so as to facilitate for the audio plug 41 connecting with an electronic product (not shown) directly. Pull the limiting portion 421 of the sliding element 42 to slide towards the holding groove 34 in the bottom of the sliding groove 32 to make the audio plug 41 project out of the holding groove 34 and the notch 21 so as to electrically connect with the electronic product for realizing an electrical connection between the loudspeaker 100 and the electronic product. The limiting portion 421 of the modulating element 40 is blocked by the blocking blocks 311 of the rotating element 30 for preventing the limiting portion 421 of the modulating element 40 from sliding out of the bottom of the sliding groove 32 so that further prevents the modulating element 40 from being apart from the rotating element 30 and the housing 20 completely.

Referring to FIGS. 1-7 again, when the modulating element 40 is rotated along a direction B shown in FIG. 1, the rotating element 30 is brought along by the limiting portion 421 of the sliding element 42 to rotate along the direction B until the first mark 35 exposed through the notch 21 for the convenience of pulling the rotating element 30 out of the housing 20. Then draw the modulating element 40 together with the rotating element 30 out of the rear of the insertion chamber 201 of the housing 20 so as to put the external batteries in the insertion chamber 201 of the housing 20.

As described above, the modulating element 40 together with the rotating element 30 rotates with respect to the housing 20 to make the audio plug 41 project out of the holding groove 34 and the notch 21 so as to facilitate for the audio plug 41 connecting with the electronic product directly, or make the first mark 35 exposed through the notch 21 for the convenience of pulling the rotating element 30 out of the housing 20 so as to put the external batteries in the insertion chamber 201 of the housing 20. Thus, the loudspeaker 100 has a compact structure to make the loudspeaker 100 portable. Furthermore, the battery in the housing 20 provides electrical energy for the loudspeaker 100 to work so as to bring convenience for listeners who want to use the loudspeaker 100 at any time.

What is claimed is:

1. A loudspeaker, comprising:

a hollow housing defining an insertion chamber extending along a front-to-rear direction to penetrate through a front face and a rear face of the housing, a rear edge of the housing being recessed forward to form a notch passing through an outer surface of the housing and further communicating with the insertion chamber;

a conducting sound element mounted in a front of the insertion chamber of the housing;

a rotating element rotatablely mounted in a rear of the insertion chamber of the housing, a rear end of an outer surface of the rotating element being recessed inward to form a holding groove penetrating rearward through a rear surface of the rotating element, a portion of the rear surface of the rotating element being recessed forward to form a sliding groove connecting with a rear of the holding groove; and a modulating element slidably mounted to the rotating element, a front surface of the modulating element being equipped with an audio plug and further protruding forward to form a sliding element slidably located in the sliding groove, the audio plug being capable of being inserted into the holding groove or projecting out of the holding groove and the notch under a rotation of the modulating element together with the rotating element with respect to the housing.

2. The loudspeaker as claimed in claim 1, wherein an inner sidewall of the sliding groove protrudes inward to form a restricting rib of a substantial U-shape from a rear view with the mouth thereof facing the holding groove, the restricting rib is spaced from a front sidewall of the sliding groove, the sliding element has a limiting portion at a front thereof which is wider than a rear of the sliding element, the limiting portion is slidably restricted between the front sidewall of the sliding groove and the restricting rib.

3. The loudspeaker as claimed in claim 2, wherein two free ends of the restricting rib protrude forward to form two blocking blocks connected with the front sidewall of the sliding groove for blocking the limiting portion from falling off the rotating element.

4. The loudspeaker as claimed in claim 1, wherein the rear end of the outer surface of the rotating element defines a first mark apart from the holding groove, an outer surface of the modulating element defines a second mark aligned with the audio plug along a radial direction of the rotation of the modulating element and the rotating element, and a third mark aligned with the first mark along the front-to-rear direction when the audio plug is inserted in the holding groove, the modulating element together with the rotating element rotates with respect to the housing to make the notch and the holding groove in alignment with each other for the convenience of taking out of the audio plug through the notch and the holding groove, or make the first mark exposed through the notch for the convenience of pulling the rotating element out of the housing so as to put external batteries in the insertion chamber of the housing.

5. The loudspeaker as claimed in claim 1, wherein the outer surface of the housing and an outer surface of the modulating element respectively define a plurality of indentations for improving the feelings of holding the loudspeaker.

* * * * *